US011796201B2

(12) United States Patent
Brahme et al.

(10) Patent No.: US 11,796,201 B2
(45) Date of Patent: Oct. 24, 2023

(54) HVAC SENSOR VALIDATION WHILE HVAC SYSTEM IS OFF

(71) Applicant: Lennox Industries Inc., Richardson, TX (US)

(72) Inventors: Amita Brahme, Dallas, TX (US); Umesh Gokhale, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 94 days.

(21) Appl. No.: 17/235,186

(22) Filed: Apr. 20, 2021

(65) Prior Publication Data

US 2022/0333807 A1 Oct. 20, 2022

(51) Int. Cl.

| | |
|---|---|
| ***F24F 11/38*** | (2018.01) |
| ***F24F 11/49*** | (2018.01) |
| ***F24F 11/52*** | (2018.01) |
| *F24F 130/10* | (2018.01) |
| *F24F 140/20* | (2018.01) |
| *F24F 140/10* | (2018.01) |
| *F24F 110/12* | (2018.01) |

(52) U.S. Cl.

CPC ..... *F24F 11/38* (2018.01); *F24F 11/49* (2018.01); *F24F 11/52* (2018.01); *F24F 2110/12* (2018.01); *F24F 2130/10* (2018.01); *F24F 2140/10* (2018.01); *F24F 2140/20* (2018.01)

(58) Field of Classification Search

CPC .. F24F 11/38; F24F 11/49; F24F 11/52; F24F 2130/10; F24F 2140/10; F24F 2110/12; F24F 2140/20; F24F 11/30; F25B 49/02; F25B 13/00; F25B 49/005; B60H 1/22

See application file for complete search history.

(56) References Cited

U.S. PATENT DOCUMENTS

2005/0251364 A1* 11/2005 Kang ..... G05B 9/02 702/183
2006/0041335 A9* 2/2006 Rossi ..... G05B 23/0235 700/276
2009/0151377 A1* 6/2009 Yonemori ..... F25B 49/005 62/203
2009/0287355 A1* 11/2009 Milder ..... F24F 11/64 700/282
2010/0106319 A1* 4/2010 Grohman ..... G05D 27/02 700/276

(Continued)

FOREIGN PATENT DOCUMENTS

CN 108800488 A * 11/2018 ..... F24F 11/00

*Primary Examiner* — Alicia M. Choi
(74) *Attorney, Agent, or Firm* — Baker Botts L.L.P.

(57) ABSTRACT

An HVAC system includes a suction-side sensor, a liquid-side sensor, an outdoor temperature sensor, and a controller. The controller determines that initial criteria are satisfied for initiating validation of the suction-side sensor and the liquid-side sensor. After determining that the initial criteria are satisfied, a suction-side property value, liquid-side property value, and outdoor temperature value are received. The controller determines whether a first validation criteria and a second validation criteria are satisfied. If both the first validation criteria and the second validation criteria are satisfied, the suction-side sensor, the liquid-side sensor, and the outdoor temperature sensor are determined to be functioning properly. Otherwise, the controller determines which one or more of the sensors are malfunctioning.

19 Claims, 4 Drawing Sheets

(56) References Cited

U.S. PATENT DOCUMENTS

| | | | | |
|---|---|---|---|---|
| 2013/0145786 | A1* | 6/2013 | Tamaki | F24D 19/1051 62/161 |
| 2013/0312443 | A1* | 11/2013 | Tamaki | F24H 4/04 62/228.1 |
| 2015/0088786 | A1* | 3/2015 | Anandhakrishnan | G16H 50/80 706/11 |
| 2015/0330650 | A1* | 11/2015 | Abiprojo | F24F 11/39 700/276 |
| 2016/0245570 | A1* | 8/2016 | Han | F25B 49/022 |
| 2016/0370026 | A1* | 12/2016 | Denton | F24F 11/38 |
| 2016/0377309 | A1* | 12/2016 | Abiprojo | F24F 11/47 700/276 |
| 2019/0353370 | A1* | 11/2019 | Hern | F24F 1/06 |
| 2020/0284458 | A1* | 9/2020 | Yoshida | F24F 11/86 |
| 2021/0270483 | A1* | 9/2021 | Brahme | F24F 11/38 |
| 2022/0187000 | A1* | 6/2022 | Yoshimi | F25B 49/02 |
| 2022/0268503 | A1* | 8/2022 | Yoshimi | F24F 11/36 |

* cited by examiner

HVAC SENSOR VALIDATION WHILE HVAC SYSTEM IS OFF

TECHNICAL FIELD

The present disclosure relates generally to heating, ventilation, and air conditioning (HVAC) systems and methods of their use. More particularly, the present disclosure relates to HVAC sensor validation while system is off.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air.

SUMMARY OF THE DISCLOSURE

HVAC systems may include sensors for monitoring system performance and detecting system faults. For example, information from temperature and/or pressure sensors may be used to detect a loss of charge in an HVAC system and/or diagnose other system faults (e.g., malfunction of a compressor, blower, or the like). This disclosure recognizes that since sensors, such as those described above, may be relied upon to detect system faults and take appropriate corrective actions, any failure or malfunction of the sensors should be identified as efficiently, reliably, and quickly as possible. However, there is generally a lack of tools for detecting problems associated with sensors deployed in and around an HVAC system.

This disclosure provides technical solutions to problems of previous technology, including those described above, by facilitating more efficient and reliable sensor validation than was previously possible. The systems and sensor validation approaches described here may be adapted to any HVAC, heat pump, or refrigeration system, regardless of size or configuration. As described further below, sensor validation is performed while the system is in an off state (i.e., when the system is not cooling or heating a space). Prior to sensor validation, the controller determines whether a sufficient amount of time has passed since the end of cooling or heating operation. Measurements are recorded by the sensors, and based on whether certain validation criteria are met, specific sensors are identified that are faulty or malfunctioning. An alert identifying the faulty sensor(s) may be provided to initiate proactive repairs. Moreover, if measurements from a sensor identified as faulty are used for a given system fault detection protocol (e.g., to detect loss of charge or the like), automatic system fault detection activities may be temporarily paused until the appropriate repair activities are complete, thereby preventing false positive fault detections. Certain embodiments may include none, some, or all of the above technical advantages. One or more other technical advantages may be readily apparent to one skilled in the art from the figures, descriptions, and claims included herein.

In an embodiment, an HVAC system includes a suction-side sensor positioned and configured to measure a suction-side property of the HVAC system, a liquid-side sensor positioned and configured to measure a liquid-side property of the HVAC system, an outdoor temperature sensor positioned and configured to measure an outdoor temperature of an outdoor space, and a controller communicatively coupled to the suction-side sensor, the liquid-side sensor, and the outdoor temperature sensor. The controller determines that the HVAC system is not operating to provide cooling or heating to a space. The controller determines that initial criteria are satisfied for initiating validation of the suction-side sensor and the liquid-side sensor. After determining that the HVAC system is not operating to provide cooling or heating to the space and that the initial criteria are satisfied, a measured suction-side property value, measured liquid-side property value, and outdoor temperature value are received. The controller determines, by comparing the received suction-side property value to the received liquid-side property value, whether a first validation criteria is satisfied. The controller determines, by comparing the received liquid-side property value to the received outdoor temperature value, whether a second validation criteria is satisfied. If both the first validation criteria and the second validation criteria are satisfied, the suction-side sensor, the liquid-side sensor, and the outdoor temperature sensor are determined to be functioning properly. If both the first validation criteria and the second validation criteria are not satisfied, the liquid-side sensor is determined to be malfunctioning, and an alert is provided indicating the malfunctioning liquid-side sensor. If the first validation criteria is satisfied and the second validation criteria is not satisfied, the outdoor temperature sensor is determined to be malfunctioning, and an alert is provided indicating the malfunctioning outdoor temperature sensor. If the first validation criteria is not satisfied and the second validation criteria is satisfied, the suction-side sensor is determined to be malfunctioning, and an alert is provided indicating the malfunctioning suction-side sensor.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

As described above, prior to this disclosure, there was a lack of tools for reliably detecting potential malfunctions or failures of sensors in or around an HVAC system. The systems and methods described in this disclosure provide solutions to these problems by evaluating the performance of sensors when the HVAC system is not providing heating or cooling. The approach described in this disclosure facilitates the proactive determination of which of a number of sensors deployed in or around the HVAC system are either functioning correctly or malfunctioning. Malfunctioning sensors can be detected more rapidly and reliably than was possible using previous technology. With sensors known to be functioning properly, sensor data may be used to more reliably detect system faults (e.g. lack of charge, compressor malfunctioning, etc.), such that corrective actions can be taken before the HVAC system is damaged and without extensive downtimes during which heating or cooling cannot be provided.

As used in this disclosure, a "suction-side property" refers to a property (e.g., a temperature or pressure) associated with refrigerant provided to an inlet of the compressor. For example, a suction-side property may be a temperature or pressure of refrigerant provided to a compressor of an HVAC system (e.g., refrigerant flowing into the inlet of the compressor or refrigerant flowing in conduit leading to the inlet of the compressor. As used in this disclosure, a "liquid-side property" refers to a property (e.g., a temperature or pressure) associated with refrigerant provided from the compressor. For example, a liquid-side property may be a temperature or pressure of refrigerant provided from a compressor of an HVAC system (e.g., refrigerant flowing out of the outlet of the compressor or refrigerant flowing in conduit leading from the outlet of the compressor), refrigerant at the outlet of a condenser of the HVAC system, or refrigerant at any appropriate point downstream of the compressor.

HVAC System

Figure 1:
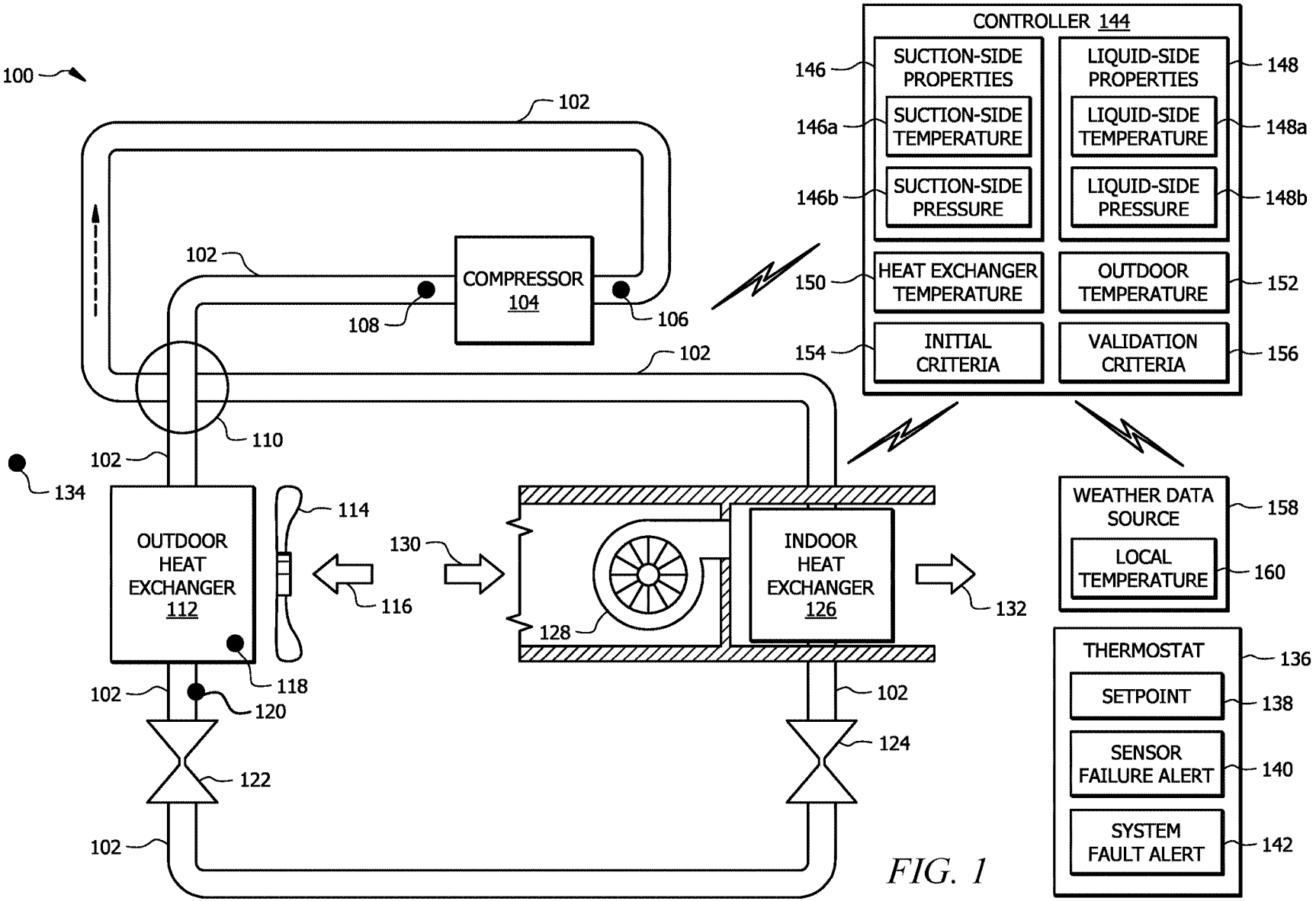
FIG. 1 is a diagram of an example HVAC system configured for automatic sensor validation.

FIG. 1 shows an example HVAC system 100. The HVAC system 100 conditions air for delivery to a conditioned space. The conditioned space may be, for example, a room, a house, an office building, a warehouse, a refrigerated container, or the like. The HVAC system 100 may be configured as shown in FIG. 1 or in any other suitable configuration. For example, the HVAC system 100 may include additional components or may omit one or more components shown in FIG. 1. The HVAC system 100 includes a refrigerant conduit subsystem 102, a compressor 104, an outdoor heat exchanger 112, a heating expansion device 122, a cooling expansion device 124, an indoor heat exchanger 126, a thermostat 136, and a controller 144. The controller 144 is configured to validate the performance of one or more sensors 106, 108, 118, 120, 134 on, within, or around the HVAC system 100. For example, the controller 144 may be configured to determine whether the HVAC system 100 satisfies initial criteria 154 for evaluating the performance of sensors 106, 108, 118, 120, 134 (e.g., criteria 154 that the HVAC system 100 is not being operated to provide heating or cooling for at least a threshold amount of time). After the initial criteria 154 are satisfied, the controller 144 compares measured suction-side properties 146 to measured liquid-side properties 148, using validation criteria 156, to determine whether sensor readings are validated or whether one or more of the sensors 106, 108, 118, 120, 134 may be faulty or malfunctioning.

The refrigerant conduit subsystem 102 facilitates the movement of a refrigerant through various components of the HVAC system 100. The refrigerant may be any acceptable refrigerant including, but not limited to, fluorocarbons (e.g. chlorofluorocarbons), ammonia, non-halogenated hydrocarbons (e.g., propane), hydroflurocarbons (e.g. R-410A), or any other suitable type of refrigerant.

At least one compressor 104 is coupled to the refrigerant conduit subsystem 102 and compresses (i.e., increases the pressure of) the refrigerant. The compressor 104 may be a single speed compressor, a variable speed compressor, or multi-stage compressor. A single speed compressor is generally configured to operate at a single speed to compress refrigerant flowing through the refrigerant conduit subsystem 102. A variable speed compressor is generally configured to operate at different speeds to increase the pressure of the refrigerant to keep the refrigerant moving along the refrigerant conduit subsystem 102. If compressor 104 is a variable speed compressor, the speed of compressor 104 can be modified to adjust the cooling or heating capacity of the HVAC system 100. Meanwhile, a multi-stage compressor may include multiple compressors (one or more single speed compressors and/or one or more variable speed compressors), each configured to increase the pressure of the refrigerant to keep the refrigerant moving along the refrigerant conduit subsystem 102. For example, in a multi-stage compressor configuration, one or more compressors can be turned on or off to adjust the cooling and/or heating capacity of the HVAC system 100.

The compressor 104 is in signal communication with the controller 144 using a wired and/or wireless connection. The controller 144 provides commands or signals to control operation of the compressor 104 and/or receives signals from the compressor 104 corresponding to a status of the compressor 104. For example, when the compressor 104 is a variable speed compressor, the controller 144 may provide a signal to control the compressor speed. When the compressor 104 is a multi-stage compressor, a signal from the controller 144 may provide an indication of the number of compressors to turn on and off to adjust the compressor 104 for a given cooling or heating capacity. The controller 144 may provide a signal to the compressor 104 causing the compressor 104 to turn off such that heating or cooling is not provided by the HVAC system 100. The controller 144 may operate the compressor 104 in different modes corresponding to a user request (e.g., for heating or cooling) and/or load conditions (e.g., the amount of cooling or heating requested by the thermostat 136). The controller 144 is described in greater detail below with respect to FIG. 4.

One or more suction-side sensors 106 is generally positioned and configured to measure suction-side properties 146 associated with refrigerant provided to an inlet of the compressor 104. The suction-side properties 146 may include a suction-side temperature 146*a* (i.e., the temperature of refrigerant flowing into the compressor 104) and a suction-side pressure 146*b* (i.e., the pressure of refrigerant flowing into the compressor 104). The suction-side sensor(s) 106 may be located in, on, or near the inlet of the compressor 104 to measure properties of the refrigerant flowing into the compressor 104 or in any other appropriate location. The suction-side sensor(s) 106 are in signal communication with the controller 144 via wired and/or wireless connection and are configured to provide the suction-side properties 146 to the controller 144, as illustrated in FIG. 1. The suction-side properties 146 are generally provided as an electronic signal that is interpretable by the controller 144. For example, the suction-side sensor(s) 106 may provide an indication of the suction-side properties 146 (e.g., a current or voltage proportional to the measured suction-side properties 146) or may provide a signal which may be used by the controller 144 to calculate the suction-side properties 146. The example of FIG. 1 illustrates the suction-side sensor(s) 106 positioned in the refrigerant conduit subsystem 102 proximate to the inlet of the compressor 104. However, it should be understood that the suction-side sensor(s) 106 may be positioned in any other appropriate position (e.g., in the inlet of the compressor 104 or further upstream of the inlet of the compressor 104).

One or more liquid-side sensors 108, 120 are generally positioned and configured to measure liquid-side properties 148 associated with refrigerant provided from an outlet of the compressor 104 (sensor(s) 108) and/or an outlet of the outdoor heat exchanger 112 (sensor(s) 120). The liquid-side properties 148 may include a liquid-side temperature 150*a* (i.e., the temperature of refrigerant flowing out of the compressor 104 or the outdoor heat exchanger 112) and a liquid-side pressure 148*b* (i.e., the pressure of refrigerant flowing out of the compressor 104 or the outdoor heat exchanger 112). In some cases, liquid-side sensor(s) 108 may be located in, on, or near the outlet of the compressor 104 to measure properties of the refrigerant flowing out of the compressor 104 (e.g., in a compressed, liquid form). In some cases, liquid-side sensor(s) 120 may be located in, on, or near the outlet of the outdoor heat exchanger 112 to measure properties of the refrigerant flowing out of the outdoor heat exchanger 112 (e.g., in a cooled, liquid form). The liquid-side sensor(s) 108, 120 are in signal communication with the controller 144 via wired and/or wireless connection and are configured to provide the liquid-side properties 148 to the controller 144, as illustrated in FIG. 1. Similarly to the suction-side properties 146, the liquid-side properties 148 are generally provided as an electronic signal that is interpretable by the controller 144. For example, the liquid-side sensor(s) 108, 120 may provide an indication of the liquid-side properties 148 (e.g., a current or voltage proportional to the measured liquid-side properties 148) or may provide a signal which may be used by the controller 144 to calculate the liquid-side properties 148. The example of FIG. 1 illustrates the liquid-side sensor(s) 108 positioned in the refrigerant conduit subsystem 102 proximate to the outlet of the compressor 104 and liquid-side sensor(s) 120 positioned in the refrigerant conduit subsystem 102 proximate to the outlet of the outdoor heat exchanger 112. However, it should be understood that the liquid-side sensor(s) 108, 120 may be positioned in any other appropriate position (e.g., in the outlet of the compressor 104/heat exchanger 112 or further downstream from the outlet of the compressor 104/heat exchanger 112).

The reversing valve 110 is fluidically connected to the compressor 104, outdoor heat exchanger 112 and indoor heat exchanger 126. The reversing valve 110 is generally any valve which may be adjusted to different configurations to provide either cooling (as in the configuration of FIG. 1) or heating (heating configuration not shown for clarity and conciseness) to a space. In the example of FIG. 1, the HVAC system 100 includes a reversing valve 110 and is configured to operate as a heat pump, such that heating or cooling can be provided based on the configuration of the reversing valve 110. In other embodiments (not shown for clarity and conciseness), the HVAC system 100 does not act as a heat pump and cooling is provided through the compression-expansion cycle of refrigerant, while heating may be provided through a separate heating element, such as a furnace or resistive heater. In embodiments in which the HVAC system 100 is not a heat pump system, the HVAC system 100 may not include the reversing valve 110 and/or the outdoor heat exchanger temperature sensor 118, described below.

The outdoor heat exchanger 112 is configured to facilitate movement of the refrigerant through the refrigerant conduit subsystem 102. The outdoor heat exchanger 112 is generally configured to act as a condenser (e.g., to cool and condense refrigerant passing therethrough) when the HVAC system 100 is in the cooling configuration illustrated in FIG. 1. In the heating configuration (not shown), the outdoor heat exchanger 112 acts as an evaporator (e.g., to heat refrigerant passing therethrough). A fan 114 is configured to move air 116 across the outdoor heat exchanger 112. For example, the fan 114 may be configured to blow outside air 116 through the outdoor heat exchanger 112 to help cool the refrigerant flowing therethrough in the cooling configuration of FIG. 1.

One or more sensors 118 may be located in, on, or near the outdoor heat exchanger 112 to measure a temperature 150 of the refrigerant associated with the outdoor heat exchanger 112. In certain embodiments, sensor(s) 118 are positioned and configured to measure temperature(s) 150 of refrigerant flowing into, through, and/or out of the outdoor heat exchanger 112. The sensor(s) 118 are in signal communication with the controller 144 using a wired and/or wireless connection and are configured to send measured temperature 150 to the controller 144. For example, the sensor(s) 118 may provide a direct indication of the temperature 150 (e.g., a current or voltage proportional to the measured subcool value) or may be used by the controller 144 to calculate the temperature 150 (e.g., based on a signal provided by the sensor(s) 118).

When the reversing valve 110 is in the cooling configuration illustrated in FIG. 1 (or when the HVAC system 100 is not configured to act as a heat pump), refrigerant flows from the outdoor heat exchanger 112 toward a cooling expansion device 124. In the cooling configuration of FIG. 1, the heating expansion device 122 is generally maintained in a fully open position. The cooling expansion device 124 is coupled to the refrigerant conduit subsystem 102 downstream of the outdoor heat exchanger 112 and is configured to remove pressure from the refrigerant before the refrigerant is provided to the indoor heat exchanger 126. When the reversing valve 110 is in the heating configuration (not shown), refrigerant flows from the indoor heat exchanger 126 toward the heating expansion device 122. In the heating configuration, the cooling expansion device 124 is generally maintained in a fully open position. The heating expansion device 122 is coupled to the refrigerant conduit subsystem 102 downstream (for the alternative heating refrigerant flow configuration not illustrated in FIG. 1) of the indoor heat exchanger 126 and is configured to remove pressure from the refrigerant before the refrigerant is provided to the outdoor heat exchanger 112.

In general, each of the heating expansion device 122 and the cooling expansion device 124 may be a valve such as an expansion valve or a flow control valve (e.g., a thermostatic expansion valve (TXV)) or any other suitable valve for removing pressure from the refrigerant while, optionally, providing control of the rate of flow of the refrigerant. Each of the heating expansion device 122 and the cooling expansion device 124 may be in communication with the controller 144 (e.g., via wired and/or wireless communication) to receive control signals for opening and/or closing associated valves and/or provide flow measurement signals corresponding to the rate of refrigerant flowing through the refrigerant subsystem 102.

The outdoor heat exchanger 126 is generally any heat exchanger configured to provide heat transfer between air flowing through the outdoor heat exchanger 126 (i.e., contacting an outer surface of one or more coils of the outdoor heat exchanger 126) and refrigerant passing through the interior of the outdoor heat exchanger 126. The outdoor heat exchanger 126 is fluidically connected to the compressor 104, such that refrigerant flows, in the cooling configuration of FIG. 1, from the indoor heat exchanger 126 to the compressor 104 via the reversing valve 110. In the heating configuration (not shown), refrigerant flows, via the reversing valve 110, from the compressor 104 to the indoor heat exchanger 126.

A blower 128 causes return air 130 to move across the indoor heat exchanger 126, such that heat transfer occurs between refrigerant passing through the indoor heat exchanger 126 and the flow of air 130. The blower 128 directs the resulting conditioned air 130 into the conditioned space. In the cooling configuration of FIG. 1, the return air 130 is cooled by the indoor heat exchanger 126 and provided to the conditioned space as a cooled conditioned air 130. In the heating configuration, the return air 130 is heated by the indoor heat exchanger 126 and provided to the conditioned space as heated conditioned air 130. The blower 128 is any mechanism for providing a flow of air through the HVAC system 100. For example, the blower 128 may be a constant-speed or variable-speed circulation blower or fan. Examples of a variable-speed blower include, but are not limited to, belt-drive blowers controlled by inverters, direct-drive blowers with electronic commuted motors (ECM), or any other suitable types of blowers. The blower 128 is in signal communication with the controller 144 using any suitable type of wired and/or wireless connection. The controller 144 is configured to provide commands or signals to the blower 128 to control its operation. For example, the controller 144 may be configured to signal(s) to the blower 128 to cause the blower 128 to turn off to not provide cooling or heating to a space, to control the speed of the blower 128, and/or to receive signals associated with a speed and/or status of the blower 128.

The HVAC system 100 includes one or more outdoor temperature sensors 134 in signal communication with the controller 144. The outdoor temperature sensor(s) 134 provide an outdoor temperature 152 to the controller 144. The outdoor temperature 152 is generally provided as an electronic signal that is interpretable by the controller 144. For example, the outdoor temperature sensor(s) 134 may provide an indication of the outdoor temperature 152 (e.g., a current or voltage proportional to the measured outdoor temperature 152) or may provide a signal which may be used by the controller 144 to calculate the outdoor temperature 152. In some embodiments, the outdoor temperature 152 may be provided and/or determined from information provided by a weather data source 158. For example, the weather data source 158 may provide current and/or forecast weather information, which includes historical, current, and/or forecast measurements of the local temperature 160, corresponding to a likely value of outdoor temperature 152 for the geographic location of the HVAC system 100. For instance, if a measured outdoor temperature 152 is not available, the local temperature 160 may be used in its place. The HVAC system 100 may include one or more additional sensors (not shown for clarity and conciseness) to measure other properties of the conditioned space, the HVAC system 100, and/or the surrounding environment. These sensors may include any suitable sensor positioned and configured to measure air temperature and/or any other property(ies) (e.g., humidity) of the conditioned space, the HVAC system 100, and/or the surrounding environment. As long as additional sensors are located on or in an outdoor portion of the HVAC system 100, the same or a similar approach may be used, as is described in this disclosure, to detect a malfunction or failure of the sensors. Such additional sensors may be located at any position on or in the outdoor portion of the HVAC system 100.

The HVAC system 100 includes one or more thermostats 136, for example located within the conditioned space (e.g. a room or building). The thermostat 136 is generally in signal communication with the controller 144 using any suitable type of wired and/or wireless communications. The thermostat 136 may be a single-stage thermostat, a multi-stage thermostat, or any suitable type of thermostat. The thermostat 136 is configured to allow a user to input a desired temperature or temperature setpoint 138 for a designated space or zone such as a room in the conditioned space. The controller 144 may use information from the thermostat 136 such as the temperature setpoint 138 for controlling the compressor 104, the reversing valve 110, the fan 114, and/or the blower 128. For example, if the indoor temperature is within a predefined range (e.g., ±1° F. or the like) of the temperature setpoint 138, the controller 144 may cause the HVAC system 100 to stop providing cooling or heating to the space, for example, by turning off the compressor 104, the fan 114, and/or the blower 128.

The thermostat 136 may include a user interface for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for input of the temperature setpoint 138, display of sensor failure alerts 140 related to failed validations performed by the controller 144 (as described further below and with respect to FIGS. 2 and 3), and/or system failure alerts 142 related to the status and/or operation of the HVAC system 100 (e.g., alerts 142 related to faults detected using measurements from sensors 106, 108, 118, 120, 134).

As described in greater detail below, the controller 144 is configured to determine whether initial criteria 154 are satisfied for beginning to evaluate whether the sensors 106, 108, 118, 120, 134 are functioning properly. For example, the initial criteria 154 may include a requirement that the HVAC system 100 is not being operated to provide heating or cooling to a space (e.g., for at least a threshold time). After the initial criteria are satisfied, the controller receives or determines values of one or more of the suction-side properties 146, liquid-side properties 148, heat exchanger temperature 150, and outdoor temperature 152 and compares these values to determine whether validation criteria 156 are satisfied. Further examples and details of the operation of the controller 144 to perform sensor validation using the initial criteria 154 and validation criteria 156 are provided below with respect to the example operation of HVAC system 100 and the methods of FIGS. 2 and 3. If a sensor failure is detected (e.g., if at least one of the validation criteria 156 is not satisfied), a sensor failure alert 140 may be displayed. If a sensor 106, 108, 118, 120, 134 used to identify a particular system fault type (e.g., loss of charge, compressor malfunction, etc.) is determined to be malfunctioning, system fault alerts 142 for this fault type may be disabled at least until the sensor 106, 108, 118, 120, 134 can be repaired or replaced. In some embodiments, an alternative system fault alert 142 is presented indicating that faults of this type cannot be automatically detected. The controller 144 is described in greater detail below with respect to FIG. 4.

As described above, in certain embodiments, connections between various components of the HVAC system 100 are wired. For example, conventional cable and contacts may be used to couple the controller 144 to the various components of the HVAC system 100, including, the compressor 104, sensors 106, 108, 118, 120, 134, the reversing valve 110, the fan 114, the blower 128, and thermostat(s) 136. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 144 to other components of the HVAC system 100.

In an example operation of HVAC system 100, the system 100 is initially operating to provide cooling or heating to the space. The controller 144 then determines that an indoor temperature is within a threshold range of the temperature setpoint 138 and subsequently causes the HVAC system 100 to stop providing cooling or heating to the space. For example, the controller 144 may cause the compressor 104, fan 114, and blower 128 to turn off.

The controller 144 then determines that the HVAC system 100 is not operating to provide cooling or heating to the space. The controller 144 may determine whether other initial criteria 154 are satisfied for initiating evaluation of one or more of the sensors 106, 108, 118, 120, 134. For example, the controller 144 may determine whether an initial criteria 154 is satisfied which requires that the HVAC system 100 has not been providing cooling or heating to the space for at least a threshold time (e.g., a threshold 408 of FIG. 4). The threshold time may be any appropriate value for the type, size, and/or geographic location of the HVAC system 100. As an example, the threshold time may be 45 minutes. The threshold time may be determined during an initial setup period after the HVAC system 100 is installed and brought into operation. During this initial time period, an operator or the controller 144 may determine a minimum amount of time for the validation criteria 156 (described further below) to be satisfied for the properly functioning sensors 106, 108, 118, 120, 134. In some embodiments, the threshold time is determined based at least in part on the weather properties of the geographic location where the HVAC system is operating (e.g., from weather data source 158). For example, if the local temperature 160 of the geographic location generally results in only very short down times during which the HVAC system 100 is not needed to provide heating or cooling (e.g., in very warm or very cold locations), then the threshold may be reduced.

After the initial criteria 154 are determined to be satisfied, the controller 144 receives measurements of values of one or more of the suction-side properties 146, liquid-side properties 148, heat exchanger temperature 150, and outdoor temperature 152. For example, measurements of temperatures (e.g., suction-side temperature 146*a*, liquid-side temperature 148*a*, heat exchanger temperature 150, and outdoor temperature 152) may be used to determine whether certain validation criteria 156 satisfied for temperature sensors 106, 108, 118, 120, 134. Based on which validation criteria 156 are satisfied and which are not, the controller 144 determines which sensor(s) 106, 108, 118, 120, 134 are functioning properly and which are likely malfunctioning (see FIGS. 1 and 2 and TABLE 1 and the corresponding descriptions below).

TABLE 1 illustrates example validation criteria 156 which may be used by the controller 144 to determine whether the sensors 106, 108, 118, 120, 134 are functioning properly or malfunctioning. For example, if values of liquid-side temperature 148*a*, suction-side temperature 146*a*, and outdoor temperature 152 indicate that Criteria 1 is satisfied but Criteria 2 is not satisfied, then the controller 144 may determine that the outdoor temperature sensor 134 is malfunctioning. As another example, if Criteria 1 is not satisfied but Criteria 2 is satisfied, the controller 144 may determine that the suction-side temperature sensor 106 is malfunctioning. Further examples of the validation of sensors 106, 108, 118, 120, 134 using the example validation criteria 156 of TABLE 1 are described below with respect to FIG. 3.

| | Compared properties | Criteria | Example threshold |
|---|---|---|---|
| Criteria 1 (C1) | Liquid-side temperature (LT), Suction-side temperature (ST) | $\lvert LT - ST \rvert \leq$ threshold | 8° F. |
| Criteria 2 (C2) | LT, Outdoor temperature (ODT) | $\lvert LT - ODT \rvert \leq$ threshold | 5° F. |
| Criteria 3 (C3) | LT, Heat exchanger temperature (HET) | $\lvert LT - HET \rvert \leq$ threshold | 5° F. |
| Criteria 4 (C4) | Liquid-side pressure (LP), Suction-side pressure (SP) | Min < LP/SP < max | min = 0.9<br>max = 1.2 |
| Criteria 5 (C5) | LP, Saturation pressure (SPS) | $\lvert LP - SPS \rvert \leq$ threshold | 20 psig |

As a further example, the controller 144 may receive a suction-side temperature 146*a* (e.g., measured by sensor 106), a liquid-side temperature (e.g., measured by sensor 108), and an outdoor temperature 152 (e.g., measured by sensor 134 or determined from the local temperature 160). The controller 144 may compare the suction-side temperature 146*a* to the liquid-side temperature 148*a* and determine whether a first validation criteria 156 is satisfied based on this comparison. For example, the controller 144 may determine whether the difference between the suction-side temperature 146*a* and the liquid-side temperature 148*a* is less than or equal to a threshold value (see Criteria 1, C1, of TABLE 1 above). If this difference is less than or equal to the threshold value, the first validation criteria 156 is satisfied. The controller 144 may also compare the liquid-side temperature 148*a* to the outdoor temperature 152 and determine whether a second validation criteria 156 is satisfied based on this comparison. For example, the controller 144 may determine whether the difference between the liquid-side temperature 148*a* and the outdoor temperature 152 is less than or equal to a threshold value (see Criteria 2, C2, of TABLE 1 above). If this difference is less than or equal to the threshold value, the second validation criteria 156 is satisfied.

If both the first and second validation criteria 156 (C1 and C2 of TABLE 1 above) are satisfied, the controller 144 determines that the suction-side sensor 106, the liquid-side sensor 108, 120, and the outdoor temperature sensor 134 are functioning properly. If both the first and second validation criteria 156 are not satisfied, the controller 144 determines that the liquid-side sensor 108, 120 is malfunctioning. The controller 144 may provide an alert 140 (e.g., for presentation on the thermostat 136) indicating the malfunctioning liquid-side sensor 108, 120. If the first validation criteria 156 is satisfied and the second validation criteria 156 is not satisfied, the controller 144 determines that the outdoor temperature sensor 134 is malfunctioning. The controller 144 may provide an alert 140 (e.g., for presentation on the thermostat 136) indicating the malfunctioning outdoor temperature sensor 134. If the first validation criteria 156 is not satisfied and the second validation criteria 156 is satisfied, the controller 144 determines that the suction-side sensor 106 is malfunctioning. The controller 144 may provide an alert 140 (e.g., for presentation on the thermostat 136) indicating the malfunctioning suction-side sensor 106.

The controller 144 may validate other sensors (e.g., the heat exchanger temperature sensor 118 and/or pressure sensors 106, 108, 120, using the heat exchanger temperature 150, suction-side pressure 146*b*, and the liquid-side pressure 148*b*, as described in greater detail with respect to FIG. 3 below.

After the above validation is complete, the controller 144 may adjust how system faults are determined and/or associated fault alerts 142 are presented. For example, if a sensor failure is detected (e.g., if at least one of the validation criteria 156 is not satisfied), a sensor failure alert 140 may be displayed. If a sensor 106, 108, 118, 120, 134 used to identify a particular system fault type (e.g., loss of charge, compressor malfunction, etc.) is determined to be malfunctioning, system fault alerts 142 for this fault type may be disabled at least until the sensor 106, 108, 118, 120, 134 can be repaired or replaced. In some embodiments, an alternative system fault alert 142 is presented indicating that faults of this type cannot be detected.

Example Methods of Sensor Validation

Figure 2:
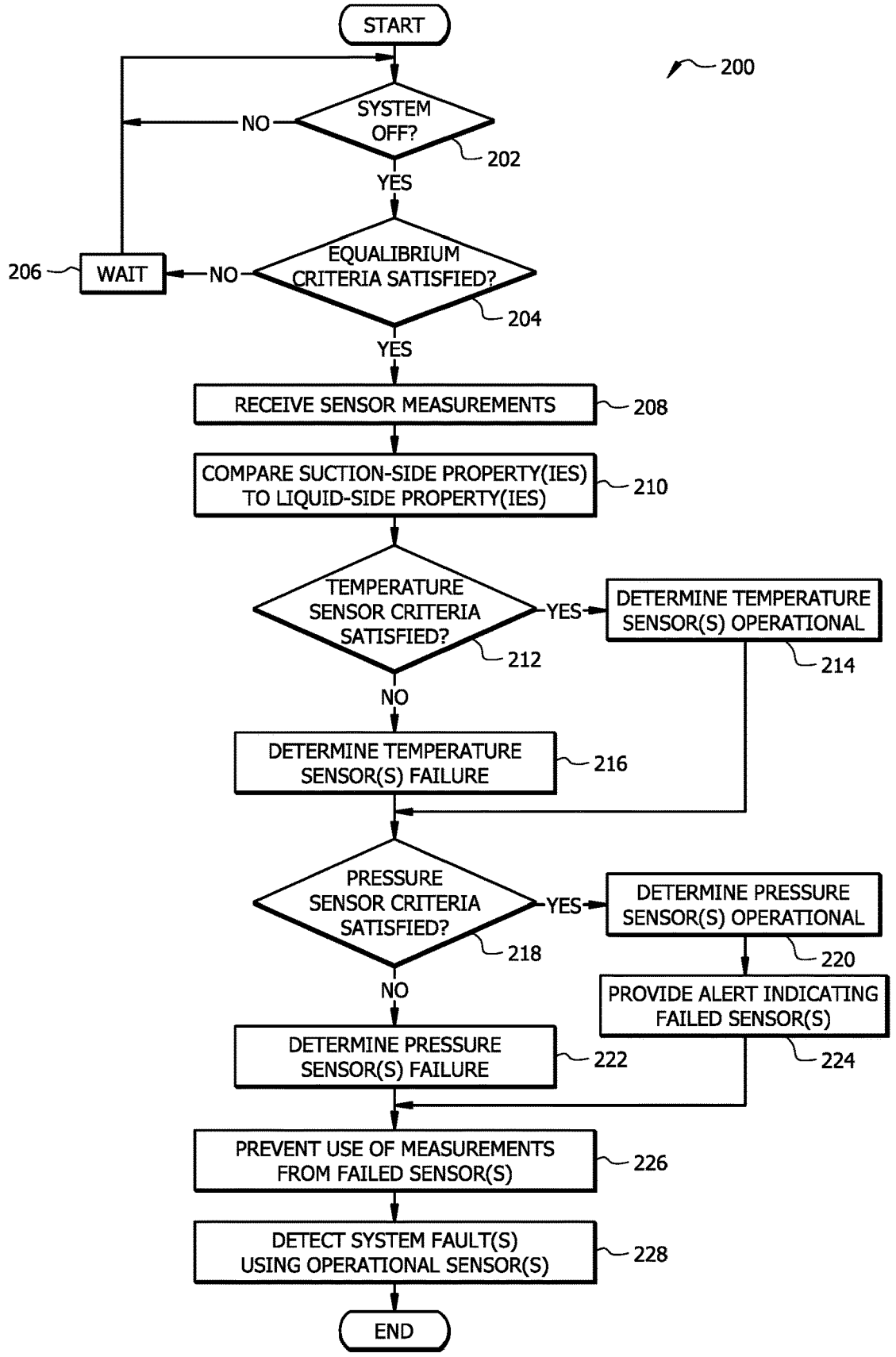
FIG. 2 is a flowchart illustrating an example method of performing validation of sensors of the system of FIG. 1.

FIG. 2 is a flowchart of an example method 200 of operating the HVAC system 100 of FIG. 1. The method 200 facilitates the proactive detection of malfunctions of sensors 106, 108, 118, 120, 134, such that repairs can be performed more efficiently and system faults may be detected more reliably, such that fewer downtimes are needed to correct system faults. Method 200 may begin at step 202 where the controller 144 determines whether HVAC system 100 is operating to provide cooling or heating to a space (e.g., whether the system 100 is "off"). For example, the controller 144 may determine whether the compressor 104 is off. If the compressor 144 is off, the HVAC system 100 may not be being operated to provide cooling or heating to the space.

At step 204, the controller 144 determines whether initial criteria 154 are satisfied for evaluating sensor performance. For example, the controller 144 may determine whether an initial criteria 154 that the HVAC system 100 has not been operated to provide cooling or heating for at least a threshold time (e.g., a threshold 408 of FIG. 4) is satisfied. If the threshold time is not yet reached, the controller 144 proceeds to step 206 and waits longer before returning to step 202. If the initial criteria 154 are satisfied at step 204, the controller 144 proceeds to step 208.

At step 208, the controller 144 receives sensor measurements, including one or more of the suction-side properties 146, liquid-side properties 148, heat exchanger temperature 150, and outdoor temperature 152. As described above, the suction-side properties 146, liquid-side properties 148, heat exchanger temperature 150, and outdoor temperature 152 may be provided to the controller 14 as an electronic signal that is interpretable by the controller 144. For example, each of the sensors 106, 108, 118, 120, 134 may provide an indication of the suction-side properties 146, liquid-side properties 148, heat exchanger temperature 150, and outdoor temperature 152 (e.g., a current or voltage proportional to the measured suction-side properties 146) or may provide a signal which may be used by the controller 144 to calculate these values.

Steps 210 to 222 illustrate example operations for detecting potential sensor malfunctions. Further details of example validation criteria 156 and their use to detect specific sensor failures is described with respect to the example method of FIG. 3, described below. At step 210, the controller 144 compares values of the suction-side properties 146, liquid-side properties 148, heat exchanger temperature 150, and outdoor temperature 152. For example, as shown in the example of FIG. 3 and in TABLE 1, the controller 144 may compare (1) values of suction-side properties 146 to values of liquid-side properties 148 (see Criteria 1 and 4 of TABLE 1), (2) values of liquid-side temperature 148*a* to values of heat exchanger temperature 150 (see Criteria 2 of TABLE 1), values of liquid-side temperature 148*a* to values of outdoor temperature 152 (see Criteria 3 of TABLE 1), and/or values of liquid-side pressure 148*b* to a calculated value of saturation pressure (see Criteria 5 of TABLE 1).

At step 212, the controller 144 determines whether temperature sensor validation criteria 156 are satisfied. For example, the controller 144 may determine whether one or more of Criteria 1, 2 and 3 of TABLE 1 are satisfied, as described further below with respect to FIG. 3. For example, the controller 144 may determine whether the difference between the suction-side temperature 146*a* and the liquid side temperature 148*a* is less than or equal to a threshold value. If all temperature sensor validation criteria 156 are satisfied, the controller 144 proceeds to step 214 and determines that the temperature sensors 106, 108, 118, 120, 134 are functioning properly. Otherwise, if one or more of the temperature sensor validation criteria 156 are not satisfied, the controller 144 proceeds to step 216 and determines that one or more of the temperature sensors 106, 108, 118, 120, 134 has failed or is malfunctioning (e.g., as described further below with respect to FIG. 3).

At step 218, the controller 144 determines whether pressure sensor validation criteria 156 are satisfied. For example, the controller 144 may determine whether one or more of Criteria 4 and 5 of TABLE 1 are satisfied, as described further below. For example, the controller 144 may determine whether the ratio of the liquid-side pressure 148*b* and the suction-side pressure 146*b* is within a threshold range (e.g., determined by a minimum and maximum value included in the thresholds 408 of FIG. 4). If all pressure sensor validation criteria 156 are satisfied, the controller 144 proceeds to step 220 and determines that the pressure sensors 106, 108, 120 are functioning properly. Otherwise, if one or more of the pressure sensor validation criteria 156 are not satisfied, the controller 144 proceeds to step 222 and determines that one or more of the pressure sensors 106, 108, 120 has failed or is malfunctioning (e.g., as described further below with respect to FIG. 3).

At step 224, the controller 144 provides an alert 140 indicating the faulty or malfunctioning sensor(s) 106, 108, 118, 120, 134 determined at steps 216 and 222. At step 226, the controller 144 may prevent use of measurements from faulty or malfunctioning sensors 106, 108, 118, 120, 134 determined at steps 216 and/or 222 for system fault detection (e.g., for the detection of loss of charge, compressor malfunction, or the like). At step 226, the controller 144 may detect system faults using any of the remaining suction-side properties 146, liquid-side properties 148, heat exchanger temperature 150, and/or outdoor temperature 152 that are not received from a faulty sensor 106, 108, 118, 120, 134 and provide a fault alert 142 for any detected fault.

Modifications, additions, or omissions may be made to method 200 depicted in FIG. 2. Method 200 may include more, fewer, or other steps. For example, steps may be performed in parallel or in any suitable order. While at times discussed as controller 144, HVAC system 100, or components thereof performing the steps, any suitable HVAC system 100 or components of the HVAC system 100 may perform one or more steps of the method 200.

Figure 3:
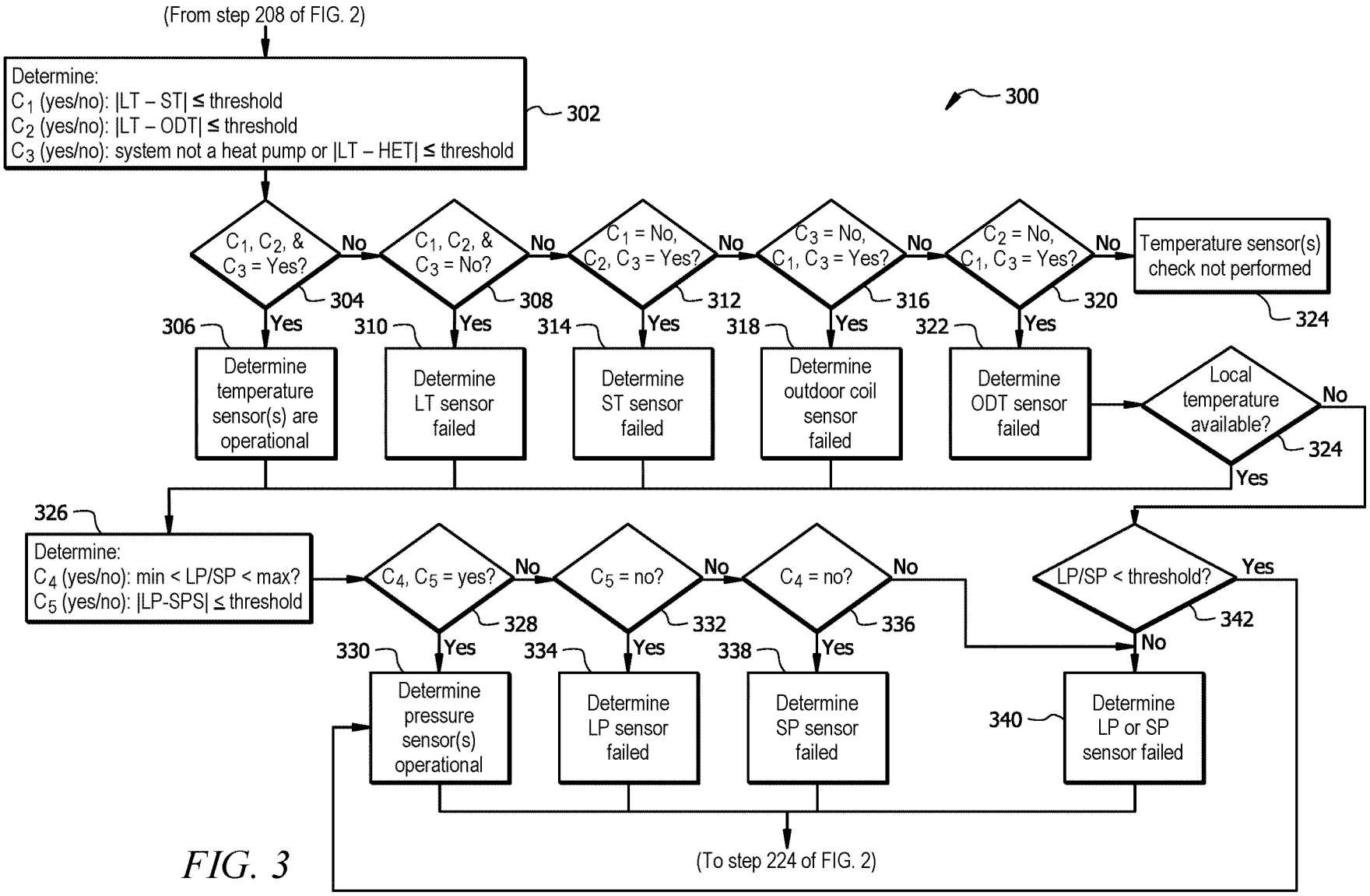
FIG. 3 is a flowchart illustrating an example method of detecting specific sensor faults based on example measurement criteria.

FIG. 3 is a flowchart of an example method 300 of identifying specific sensors 106, 108, 118, 120, 134 that are malfunctioning using the example validation criteria 156 of TABLE 1 (see above). For example, the method 300 may be used to perform functions of steps 210 to 222 of the method 200 of FIG. 2. Method 300 may begin at step 302 where the controller 144 determines whether temperature sensor validation criteria 156 are satisfied. In the example of FIG. 3, the controller 144 determines whether a first validation criteria 156 is satisfied corresponding to Criteria 1 of TABLE 1 above. For instance, the controller 144 may determine whether the absolute value of the difference between the liquid-side temperature 148*a* and the suction-side temperature 146*a* is less than or equal to a threshold value. The controller 144 also determines whether a second validation criteria 156 is satisfied corresponding to Criteria 2 of TABLE 1 above. For instance, the controller 144 may determine whether the absolute value of the difference between the liquid-side temperature 148*a* and the outdoor temperature 152 is less than or equal to a threshold value. The controller 144 also determines whether a third validation criteria 156 is satisfied corresponding to Criteria 3 of TABLE 1 above. For instance, the controller 144 may determine whether either there is no heat exchanger temperature sensor 118 in the HVAC system 100 or the absolute value of the difference between the liquid-side temperature 148*a* and the heat exchanger temperature 150 is less than or equal to a threshold value. A "yes/no" designation (or similar) is determined for each of these validation criteria 156.

At step 304, the controller 144 determines whether all of the temperature sensor validation criteria 156 (e.g., Criteria 1, 2, and 3 of TABLE 1) are satisfied. If all of the temperature sensor validation criteria 156 are satisfied (e.g., if Criteria 1, 2, and 3 of TABLE 1 are satisfied), the controller 144 proceeds to step 306 and determines that the temperature sensors 106, 108, 118, 120, 134 are functioning correctly. For example, the controller 144 may determine that the suction-side temperature sensor 106, liquid-side temperature sensor 108, 120, heat exchanger temperature sensor 118 (if present in the HVAC system 100), and the outdoor temperature sensor 134 are functioning properly. The controller 144 then proceeds to step 326. If the condition at step 304 is not satisfied, the controller 144 proceeds to step 308.

At step 308, the controller 144 determines whether all of the temperature sensor validation criteria 156 (e.g., Criteria 1, 2, and 3 of TABLE 1) are not satisfied. If all of the temperature sensor validation criteria 156 are not satisfied (e.g., if Criteria 1, 2, and 3 of TABLE 1 are satisfied), the controller 144 proceeds to step 310 and determines that the liquid-side temperature sensor 108, 120 has failed or is malfunctioning. The controller 144 then proceeds to step 326. If the condition at step 308 is not satisfied, the controller 144 proceeds to step 312.

At step 312, the controller 144 determines whether a particular sensor validation criteria 156 (i.e. Criteria 1 of TABLE 1) is not satisfied while the other validation criteria (e.g., Criteria 2 and 3 of TABLE 1) are satisfied. If this condition is met, the controller 144 proceeds to step 314 and determines that the suction-side temperature sensor 106 has failed or is malfunctioning. The controller 144 then proceeds to step 326. If the condition at step 312 is not satisfied, the controller 144 proceeds to step 316.

At step 316, the controller 144 determines whether a particular sensor validation criteria 156 (i.e. Criteria 3 of TABLE 1) is not satisfied while the other validation criteria (e.g., Criteria 1 and 2 of TABLE 1) are satisfied. If this condition is met, the controller 144 proceeds to step 318 and determines that the heat exchanger temperature sensor 118 has failed or is malfunctioning. The controller 144 then proceeds to step 326. If the condition at step 316 is not satisfied, the controller 144 proceeds to step 320.

At step 320, the controller 144 determines whether a particular sensor validation criteria 156 (i.e. Criteria 2 of TABLE 1) is not satisfied while the other validation criteria (e.g., Criteria 1 and 3 of TABLE 1) are satisfied. If this condition is met, the controller 144 proceeds to step 322 and determines that the outdoor temperature sensor 134 has failed or is malfunctioning. The controller 144 then proceeds to step 324 to determine if a local temperature 160 is available from a weather data source 158. If a local temperature 160 is available, the controller 144 proceeds to step 326. Otherwise, the controller 144 proceeds to step 342 (described below). If the condition at step 320 is not satisfied, the method 300 ends.

At step 326, the controller 144 determines whether pressure sensor validation criteria 156 are satisfied. In the example of FIG. 3, the controller 144 determines whether a fourth validation criteria 156 is satisfied corresponding to Criteria 4 of TABLE 1 above. For instance, the controller 144 may determine whether the ratio of the liquid-side pressure 148*b* to the suction-side pressure 146*b* (LP/SP) is within a threshold range (e.g., determined by minimum and maximum threshold values of thresholds 408 of FIG. 4).

Still referring to step 326, the controller 144 also determines whether a fifth validation criteria 156 is satisfied corresponding to Criteria 5 of TABLE 1 above. The fifth validation criteria 156 may involve a determination of whether an absolute value of the difference between the liquid-side pressure 148*b* and a saturation pressure (SPS) (e.g., saturation pressure 412 of FIG. 4) for the HVAC system 100 is less than or equal to a threshold value. The saturation pressure is the equilibrium pressure of the refrigerant at the current outdoor temperature 152. The controller 144 may determine the saturation pressure for the HVAC system 100 using the outdoor temperature 152 and an appropriate lookup table or equation (e.g., table or equation 410 of FIG. 4) for the refrigerant used in the HVAC system 100. In cases in which the outdoor temperature sensor 134 is not functioning properly (e.g., as determined at step 322), the controller 144 may use the local temperature 160 from weather data source 158 in place of the measured outdoor temperature 152 (see step 324). The controller 144 compares this calculated saturation pressure to the liquid-side pressure 148*b* to determine if the fifth validation criteria 156 (Criteria 5 of TABLE 1) is satisfied.

At step 328, the controller 144 determines whether all of the pressure sensor validation criteria 156 (e.g., Criteria 4 and 5 of TABLE 1) are satisfied. If this condition is met, the controller 144 proceeds to step 330 and determines that the suction-side pressure sensor 106 and liquid-side pressure sensor 108, 102 are functioning properly. If this condition is not met, the controller 144 proceeds to step 332.

At step 332, the controller 144 determines whether a particular pressure sensor validation criteria 156 (e.g., Criteria 4 of TABLE 1) is not satisfied. If this condition is met, the controller 144 proceeds to step 334 and determines that the liquid-side pressure sensor 108, 120 is not functioning properly. If this condition is not met, the controller 144 proceeds to step 336.

At step 336, the controller 144 determines whether a particular pressure sensor validation criteria 156 (e.g., Criteria 5 of TABLE 1) is not satisfied. If this condition is met, the controller 144 proceeds to step 338 and determines that the suction-side pressure sensor 106 is not functioning properly. If this condition is not met, the controller 144 proceeds to step 340 where the controller 144 determines that either the suction-side pressure sensor 106 or the liquid-side pressure sensor 108, 120 is not functioning properly.

Returning to step 324 above, if the controller 144 determines that both the outdoor temperature sensor 134 is not functioning properly and that the local temperature 160 is not available, the controller 144 proceeds to step 342 (e.g., because an appropriate temperature is not available to determine the saturation pressure value needed to evaluate Criteria 5 of TABLE 1). At step 342, the controller 144 determines whether the ratio of the liquid-side pressure 148*b* to the suction-side pressure 146*b* is less than threshold value (e.g., a threshold 408 of FIG. 4). If this criteria is met, the controller 144 proceeds to step 330 and determines that the suction-side pressure sensor 106 and liquid-side pressure sensor 108, 102 are functioning properly. If this criteria is not met, the controller proceeds to step 340 and determines that either the suction-side pressure sensor 106 or the liquid-side pressure sensor 108, 120 is not functioning properly.

Modifications, additions, or omissions may be made to method 300 depicted in FIG. 3. Method 300 may include more, fewer, or other steps. For example, steps may be performed in parallel or in any suitable order. While at times discussed as controller 144, HVAC system 100, or components thereof performing the steps, any suitable HVAC system 100 or components of the HVAC system 100 may perform one or more steps of the method 300.

Example Controller

Figure 4:
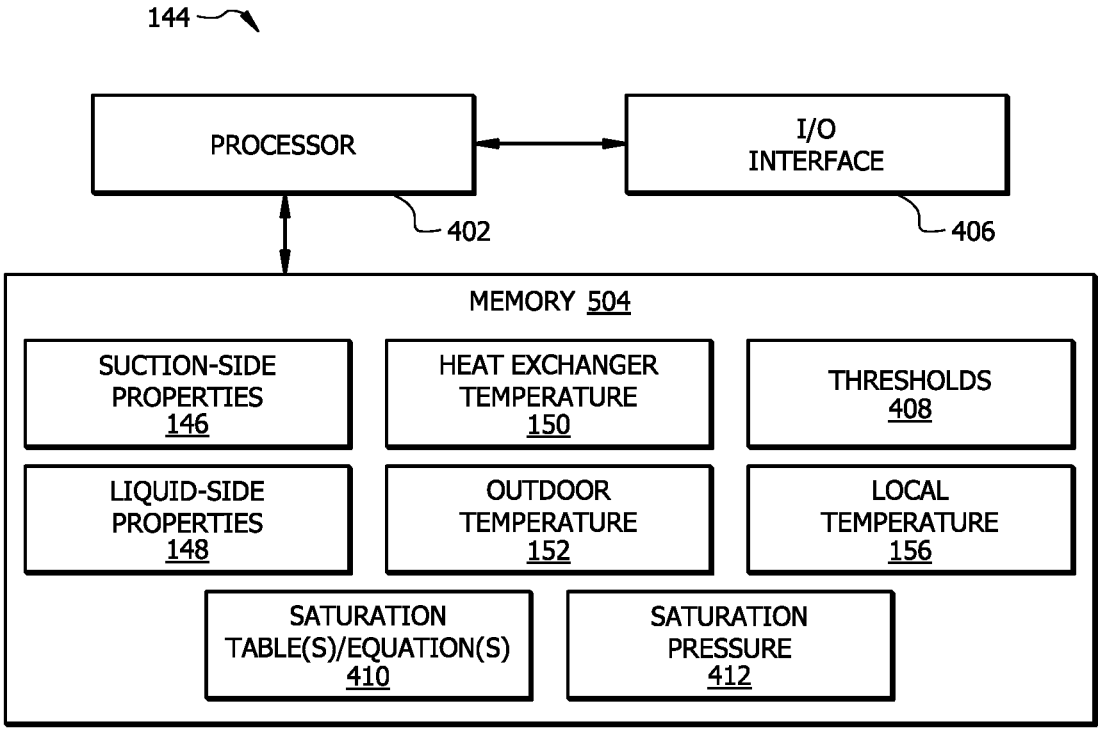
FIG. 4 is a diagram of the controller of the example HVAC system of FIG. 1.

FIG. 4 is a schematic diagram of an embodiment of the controller 144 of FIG. 1. The controller 144 includes a processor 402, a memory 404, and an input/output (I/O) interface 406.

The processor 402 includes one or more processors operably coupled to the memory 404. The processor 402 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 404 and controls the operation of HVAC system 100. The processor 402 may be a programmable logic device, a microcontroller, a microprocessor, or any suitable combination of the preceding. The processor 402 is communicatively coupled to and in signal communication with the memory 404. The one or more processors are configured to process data and may be implemented in hardware or software. For example, the processor 402 may be 8-bit, 16-bit, 32-bit, 64-bit or of any other suitable architecture. The processor 402 may include an arithmetic logic unit (ALU) for performing arithmetic and logic operations, processor registers that supply operands to the ALU and store the results of ALU operations, and a control unit that fetches instructions from memory 404 and executes them by directing the coordinated operations of the ALU, registers, and other components. The processor may include other hardware and software that operates to process information, control the HVAC system 100, and perform any of the functions described herein (e.g., with respect to FIGS. 2 and 3). The processor 402 is not limited to a single processing device and may encompass multiple processing devices. Similarly, the controller 144 is not limited to a single controller but may encompass multiple controllers.

The memory 404 includes one or more disks, tape drives, or solid-state drives, and may be used as an over-flow data storage device, to store programs when such programs are selected for execution, and to store instructions and data that are read during program execution. The memory 404 may be volatile or non-volatile and may include ROM, RAM, ternary content-addressable memory (TCAM), dynamic random-access memory (DRAM), and static random-access memory (SRAM). The memory 404 is operable to measurements of the suction-side properties 146, liquid-side properties 148, heat exchanger temperature 150, outdoor temperature 152, local temperature 160, threshold values 408, and any other logic or instructions associated with performing the functions described in this disclosure (e.g., described above with respect to methods 200 and 300 of FIGS. 2 and 3). The threshold values 408 generally include any of the threshold values described above with respect to the example methods 200 and 300 of FIGS. 2 and 3. The saturation table(s) and/or equation(s) 410 include any data tables and/or equations used to determine the saturation pressure 412 (e.g., see step 326 of FIG. 3). The saturation pressure 412 is the equilibrium pressure of the refrigerant at the current outdoor temperature 152 or the local temperature 160 (e.g., if the outdoor temperature 152 is not available).

The I/O interface 406 is configured to communicate data and signals with other devices. For example, the I/O interface 406 may be configured to communicate electrical signals with components of the HVAC system 100 including the compressor 104, the suction-side sensor(s) 106, the liquid-side sensor(s) 108, the reversing valve 110, the fan 114, the heat exchanger sensor 118, the expansion devices 120, 122, the blower 128, outdoor temperature sensor 134, and the thermostat 136. The I/O interface may receive, for example, compressor signals, signals associated with any one or more of the sensors 106, 108, 118, 120, 134, thermostat calls, temperature setpoints, environmental conditions, and an operating mode status for the HVAC system 100 and send electrical signals to the components of the HVAC system 100. The I/O interface 406 may include ports or terminals for establishing signal communications between the controller 144 and other devices. The I/O interface 406 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation and air conditioning (HVAC) system comprising:

a suction-side sensor positioned and configured to measure a suction-side property of the HVAC system, wherein the suction-side property is a temperature of refrigerant at or near a suction side of a compressor of the HVAC system;

a liquid-side sensor positioned and configured to measure a liquid-side property of the HVAC system, wherein the liquid-side property is a temperature of refrigerant flowing downstream of the compressor in the HVAC system;

an outdoor temperature sensor positioned and configured to measure an outdoor temperature of an outdoor space; and a controller communicatively coupled to the suction-side sensor, the liquid-side sensor, and the outdoor temperature sensor, the controller comprising a processor configured to:

determine that the HVAC system is not operating to provide cooling or heating to a space;

determine that initial criteria are satisfied for initiating validation of the suction-side sensor and the liquid-side sensor;

after determining that the HVAC system is not operating to provide cooling or heating to the space and that the initial criteria are satisfied:

receive a measured suction-side property value;

receive a measured liquid-side property value;

receive an outdoor temperature value;

determine, by comparing the received suction-side property value to the received liquid-side property value, whether a first validation criteria is satisfied;

determine, by comparing the received liquid-side property value to the received outdoor temperature value, whether a second validation criteria is satisfied;

if both the first validation criteria and the second validation criteria are not satisfied, determine that the liquid-side sensor is malfunctioning and provide an alert indicating the malfunctioning liquid-side sensor;

if the first validation criteria is satisfied and the second validation criteria is not satisfied, determine that the outdoor temperature sensor is malfunctioning and provide an alert indicating the malfunctioning outdoor temperature sensor;

if the first validation criteria is not satisfied and the second validation criteria is satisfied, determine that the suction-side sensor is malfunctioning and provide an alert indicating the malfunctioning suction-side sensor; and in response to providing the alert indicating the malfunctioning liquid-side sensor, outdoor temperature sensor, or suction-side sensor:

disable a first system fault alert associated with a fault type identified by the malfunctioning liquid-side sensor, outdoor temperature sensor, or suction-side sensor; and display a secondary system fault alert indicating that the fault type cannot be detected.

2. The HVAC system of claim 1, wherein the initial criteria comprise a requirement that the HVAC system has not been providing cooling or heating to the space for at least a threshold time.

3. The HVAC system of claim 1, further comprising:

an outdoor heat exchanger temperature sensor positioned and configured to measure a temperature of an outdoor heat exchanger of the HVAC system;

wherein the processor is further communicatively coupled to the temperature sensor and configured to:

receive an outdoor heat exchanger temperature value from the outdoor heat exchanger temperature sensor;

determine, by comparing the received liquid-side property value to the received outdoor heat exchanger temperature value, whether a third validation criteria is satisfied;

if each of the first validation criteria, the second validation criteria, and the third validation criteria is satisfied, determine that the suction-side sensor, the liquid-side sensor, the outdoor temperature sensor, and the outdoor heat exchanger temperature sensor are functioning properly;

if each of the first validation criteria, the second validation criteria, and the third validation criteria is not satisfied, determine that the liquid-side sensor is malfunctioning and provide an alert indicating the malfunctioning liquid-side sensor;

if the first validation criteria and third validation criteria are satisfied and the second validation criteria is not satisfied, determine that the outdoor temperature sensor is malfunctioning and provide an alert indicating the malfunctioning outdoor temperature sensor;

if the first validation criteria is not satisfied and both the second validation criteria and the third validation criteria are satisfied, determine that the suction-side sensor is malfunctioning and provide an alert indicating the malfunctioning suction-side sensor; and if the third validation criteria is not satisfied and both the first validation criteria and the second validation criteria are satisfied, determine that the outdoor heat exchanger temperature sensor is malfunctioning and provide an alert indicating the malfunctioning outdoor heat exchanger temperature sensor.

4. The HVAC system of claim 1, wherein the system further comprises:

a suction-side pressure sensor positioned and configured to measure a suction-side pressure of the HVAC system; and a liquid-side pressure sensor positioned and configured to measure a liquid-side pressure of the HVAC system;

wherein the processor is further communicatively coupled to the suction-side pressure sensor and the liquid-side pressure sensor and configured to:

receive a suction-side pressure value;

receive a liquid-side pressure value;

determine, by comparing the received suction-side pressure value to the received liquid-side pressure value, whether a fourth validation criteria is satisfied; and if the fourth validation criteria is not satisfied, determine that the suction-side pressure sensor is malfunctioning.

5. The HVAC system of claim 1, wherein the processor is further configured to:

determine a saturation pressure for the HVAC system;

determine, by comparing the received liquid-side pressure value to the saturation pressure value, whether a fifth validation criteria is satisfied; and if the fifth validation criteria is not satisfied, determine that the liquid-side pressure sensor is malfunctioning.

6. The HVAC system of claim 5, wherein the processor is further configured to determine the saturation pressure by:

determining a local temperature included in weather data for the geographic location in which the HVAC system is operated; and determining the saturation pressure for a refrigerant flowing in the HVAC system at the local temperature.

7. The HVAC system of claim 1, wherein the system further comprises:

a suction-side pressure sensor positioned and configured to measure a suction-side pressure of the HVAC system; and a liquid-side pressure sensor positioned and configured to measure a liquid-side pressure of the HVAC system;

wherein the processor is further communicatively coupled to the suction-side pressure sensor and the liquid-side pressure sensor and configured to:

determine that the outdoor temperature sensor is malfunctioning;

after determining that the outdoor temperature sensor is malfunctioning:

receive a suction-side pressure value;

receive a liquid-side pressure value;

determine whether a ratio of the liquid-side pressure to the suction-side pressure is less than a threshold value;

if the ratio is less than the threshold value, determine that the suction-side pressure sensor and the liquid-side pressure sensor are operating properly; and if the ratio is not less than the threshold value, determine that one or both of the suction-side pressure sensor and the liquid-side pressure sensor are malfunctioning and transmit a corresponding alert.

8. A method of operating a heating, ventilation and air conditioning (HVAC) system, the method comprising:

determining that the HVAC system is not operating to provide cooling or heating to a space;

determining that initial criteria are satisfied for initiating validation of a suction-side sensor positioned and configured to measure a suction-side property of the HVAC system and a liquid-side sensor positioned and configured to measure a liquid-side property of the HVAC system, wherein the suction-side property is a temperature of refrigerant at or near a suction side of a compressor of the HVAC system, and wherein the liquid-side property is a temperature of refrigerant flowing downstream of the compressor in the HVAC system;

after determining that the HVAC system is not operating to provide cooling or heating to the space and that the initial criteria are satisfied:

receiving a measured suction-side property value;

receiving a measured liquid-side property value;

receiving an outdoor temperature value from an outdoor temperature sensor;

determining, by comparing the received suction-side property value to the received liquid-side property value, whether a first validation criteria is satisfied;

determining, by comparing the received liquid-side property value to the received outdoor temperature value, whether a second validation criteria is satisfied;

if both the first validation criteria and the second validation criteria are not satisfied, determining that the liquid-side sensor is malfunctioning and provide an alert indicating the malfunctioning liquid-side sensor;

if the first validation criteria is satisfied and the second validation criteria is not satisfied, determining that the outdoor temperature sensor is malfunctioning and provide an alert indicating the malfunctioning outdoor temperature sensor;

if the first validation criteria is not satisfied and the second validation criteria is satisfied, determining that the suction-side sensor is malfunctioning and provide an alert indicating the malfunctioning suction-side sensor; and in response to providing the alert indicating the malfunctioning liquid-side sensor, outdoor temperature sensor, or suction-side sensor:

disable a first system fault alert associated with a fault type identified by the malfunctioning liquid-side sensor, outdoor temperature sensor, or suction-side sensor; and display a secondary system fault alert indicating that the fault type cannot be detected.

9. The method of claim 8, wherein the initial criteria comprise a requirement that the HVAC system has not been providing cooling or heating to the space for at least a threshold time.

10. The method of claim 8, further comprising:

receiving an outdoor heat exchanger temperature value from an outdoor heat exchanger temperature sensor positioned and configured to measure a temperature of an outdoor heat exchanger of the HVAC system;

determining, by comparing the received liquid-side property value to the received outdoor heat exchanger temperature value, whether a third validation criteria is satisfied;

if each of the first validation criteria, the second validation criteria, and the third validation criteria is satisfied, determining that the suction-side sensor, the liquid-side sensor, the outdoor temperature sensor, and the outdoor heat exchanger temperature sensor are functioning properly;

if each of the first validation criteria, the second validation criteria, and the third validation criteria is not satisfied, determining that the liquid-side sensor is malfunctioning and provide an alert indicating the malfunctioning liquid-side sensor;

if the first validation criteria and third validation criteria are satisfied and the second validation criteria is not satisfied, determining that the outdoor temperature sensor is malfunctioning and provide an alert indicating the malfunctioning outdoor temperature sensor;

if the first validation criteria is not satisfied and both the second validation criteria and the third validation criteria are satisfied, determining that the suction-side sensor is malfunctioning and provide an alert indicating the malfunctioning suction-side sensor; and if the third validation criteria is not satisfied and both the first validation criteria and the second validation criteria are satisfied, determining that the outdoor heat exchanger temperature sensor is malfunctioning and provide an alert indicating the malfunctioning outdoor heat exchanger temperature sensor.

11. The method of claim 8, further comprising:

receiving a suction-side pressure value from a suction-side pressure sensor positioned and configured to measure a suction-side pressure of the HVAC system;

receiving a liquid-side pressure value from a liquid-side pressure sensor positioned and configured to measure a liquid-side pressure of the HVAC system;

determining, by comparing the received suction-side pressure value to the received liquid-side pressure value, whether a fourth validation criteria is satisfied; and if the fourth validation criteria is not satisfied, determining that the suction-side pressure sensor is malfunctioning.

12. The method of claim 8, further comprising:

determining a saturation pressure for the HVAC system;

determining, by comparing the received liquid-side pressure value to the saturation pressure value, whether a fifth validation criteria is satisfied; and if the fifth validation criteria is not satisfied, determining that the liquid-side pressure sensor is malfunctioning.

13. The method of claim 12, further comprising determining the saturation pressure by:

determining a local temperature included in weather data for the geographic location in which the HVAC system is operated; and determining the saturation pressure for a refrigerant flowing in the HVAC system at the local temperature.

14. The method of claim 8, further comprising:

determining that the outdoor temperature sensor is malfunctioning;

after determining that the outdoor temperature sensor is malfunctioning:

receiving a suction-side pressure value from a suction-side pressure sensor positioned and configured to measure a suction-side pressure of the HVAC system;

receiving a liquid-side pressure value from a liquid-side pressure sensor positioned and configured to measure a liquid-side pressure of the HVAC system;

determining whether a ratio of the liquid-side pressure to the suction-side pressure is less than a threshold value;

if the ratio is less than the threshold value, determining that the suction-side pressure sensor and the liquid-side pressure sensor are operating properly; and if the ratio is not less than the threshold value, determining that one or both of the suction-side pressure sensor and the liquid-side pressure sensor are malfunctioning and transmit a corresponding alert.

15. A controller of a heating, ventilation and air conditioning (HVAC) system, the controller comprising:

an input/output interface operable to communicate with:

a suction-side sensor positioned and configured to measure a suction-side property of the HVAC system, wherein the suction-side property is a temperature of refrigerant at or near a suction side of a compressor of the HVAC system;

a liquid-side sensor positioned and configured to measure a liquid-side property of the HVAC system, wherein the liquid-side property is a temperature of refrigerant flowing downstream of the compressor in the HVAC system; and an outdoor temperature sensor positioned and configured to measure an outdoor temperature of an outdoor space; and a processor communicatively coupled to the input/output interface, the processor configured to:

determine that the HVAC system is not operating to provide cooling or heating to a space;

determine that initial criteria are satisfied for initiating validation of the suction-side sensor and the liquid-side sensor;

after determining that the HVAC system is not operating to provide cooling or heating to the space and that the initial criteria are satisfied:

receive a measured suction-side property value;

receive a measured liquid-side property value;

receive an outdoor temperature value;

determine, by comparing the received suction-side property value to the received liquid-side property value, whether a first validation criteria is satisfied;

determine, by comparing the received liquid-side property value to the received outdoor temperature value, whether a second validation criteria is satisfied;

if both the first validation criteria and the second validation criteria are not satisfied, determine that the liquid-side sensor is malfunctioning and provide an alert indicating the malfunctioning liquid-side sensor;

if the first validation criteria is satisfied and the second validation criteria is not satisfied, determine that the outdoor temperature sensor is malfunctioning and provide an alert indicating the malfunctioning outdoor temperature sensor;

if the first validation criteria is not satisfied and the second validation criteria is satisfied, determine that the suction-side sensor is malfunctioning and provide an alert indicating the malfunctioning suction-side sensor; and in response to providing the alert indicating the malfunctioning liquid-side sensor, outdoor temperature sensor, or suction-side sensor:

disable a first system fault alert associated with a fault type identified by the malfunctioning liquid-side sensor, outdoor temperature sensor, or suction-side sensor; and display a secondary system fault alert indicating that the fault type cannot be detected.

16. The controller of claim 15, wherein:

the input/output interface is further operable to communicate with an outdoor heat exchanger temperature sensor positioned and configured to measure a temperature of an outdoor heat exchanger of the HVAC system; and the processor is further configured to:

receive an outdoor heat exchanger temperature value from the outdoor heat exchanger temperature sensor;

determine, by comparing the received liquid-side property value to the received outdoor heat exchanger temperature value, whether a third validation criteria is satisfied;

if each of the first validation criteria, the second validation criteria, and the third validation criteria is satisfied, determine that the suction-side sensor, the liquid-side sensor, the outdoor temperature sensor, and the outdoor heat exchanger temperature sensor are functioning properly;

if each of the first validation criteria, the second validation criteria, and the third validation criteria is not satisfied, determine that the liquid-side sensor is malfunctioning and provide an alert indicating the malfunctioning liquid-side sensor;

if the first validation criteria and third validation criteria are satisfied and the second validation criteria is not satisfied, determine that the outdoor temperature sensor is malfunctioning and provide an alert indicating the malfunctioning outdoor temperature sensor;

if the first validation criteria is not satisfied and both the second validation criteria and the third validation criteria are satisfied, determine that the suction-side sensor is malfunctioning and provide an alert indicating the malfunctioning suction-side sensor; and if the third validation criteria is not satisfied and both the first validation criteria and the second validation criteria are satisfied, determine that the outdoor heat exchanger temperature sensor is malfunctioning and provide an alert indicating the malfunctioning outdoor heat exchanger temperature sensor.

17. The controller of claim 15, wherein:

the input/output interface is further operable to communicate with:

a suction-side pressure sensor positioned and configured to measure a suction-side pressure of the HVAC system; and a liquid-side pressure sensor positioned and configured to measure a liquid-side pressure of the HVAC system; and the processor is further configured to:

receive a suction-side pressure value;

receive a liquid-side pressure value;

determine, by comparing the received suction-side pressure value to the received liquid-side pressure value, whether a fourth validation criteria is satisfied; and if the fourth validation criteria is not satisfied, determine that the suction-side pressure sensor is malfunctioning.

18. The controller of claim 15, wherein the processor is further configured to:

determine a saturation pressure for the HVAC system;

determine, by comparing the received liquid-side pressure value to the saturation pressure value, whether a fifth validation criteria is satisfied; and if the fifth validation criteria is not satisfied, determine that the liquid-side pressure sensor is malfunctioning.

19. The controller of claim 18, wherein the processor is further configured to determine the saturation pressure by:

determining a local temperature included in weather data for the geographic location in which the HVAC system is operated; and determining the saturation pressure for a refrigerant flowing in the HVAC system at the local temperature.

* * * * *